US008967900B2

(12) United States Patent
Anderson et al.

(10) Patent No.: US 8,967,900 B2
(45) Date of Patent: Mar. 3, 2015

(54) HYGIENIC WRITING INSTRUMENT AND METHOD OF USING

(71) Applicants: James M. Anderson, Murrieta, CA (US); Sanjay Agarwal, Madison, WI (US)

(72) Inventors: James M. Anderson, Murrieta, CA (US); Sanjay Agarwal, Madison, WI (US)

( * ) Notice: Subject to any disclaimer, the term of this patent is extended or adjusted under 35 U.S.C. 154(b) by 112 days.

(21) Appl. No.: 13/837,946

(22) Filed: Mar. 15, 2013

(65) Prior Publication Data

US 2014/0023424 A1 Jan. 23, 2014

Related U.S. Application Data

(60) Provisional application No. 61/741,280, filed on Jul. 17, 2012.

(51) Int. Cl.

| | |
|---|---|
| ***B43K 29/00*** | (2006.01) |
| ***B43K 8/00*** | (2006.01) |
| ***B43K 23/00*** | (2006.01) |
| ***B43K 29/18*** | (2006.01) |
| ***B43K 5/00*** | (2006.01) |
| ***B43K 7/00*** | (2006.01) |

(52) U.S. Cl.

CPC ..... *B43K 29/00* (2013.01); *B43K 8/003* (2013.01); *B43K 23/00* (2013.01); *B43K 29/004* (2013.01); *B43K 29/18* (2013.01); *B43K 5/005* (2013.01); *B43K 7/005* (2013.01)

USPC ..... 401/195; 401/88; 401/9

(58) Field of Classification Search

USPC ..... 401/9–11, 195, 52, 88, 107, 108, 209, 401/221, 226, 248, 251

See application file for complete search history.

(56) References Cited

U.S. PATENT DOCUMENTS

| | | | | |
|---|---|---|---|---|
| 4,108,559 | A | 8/1978 | Dick et al. | |
| 5,683,655 | A * | 11/1997 | Carter | 422/28 |
| 6,095,706 | A | 8/2000 | Hashimoto et al. | |
| 6,202,862 | B1 | 3/2001 | Acquaviva et al. | |
| 6,273,627 | B1 | 8/2001 | Mittersinker et al. | |
| 6,409,404 | B1 * | 6/2002 | Piech | 401/131 |
| 6,609,846 | B1 | 8/2003 | Lai et al. | |
| 6,749,354 | B2 | 6/2004 | Kageyama et al. | |
| 6,979,143 | B2 | 12/2005 | Goldberg | |
| 7,001,093 | B2 | 2/2006 | Rosso | |
| 7,070,352 | B2 | 7/2006 | Iida et al. | |
| 7,147,392 | B2 | 12/2006 | Bedhome et al. | |
| 7,168,105 | B2 | 1/2007 | Adelman | |
| 7,329,063 | B2 | 2/2008 | Kato | |
| 7,334,954 | B1 * | 2/2008 | Rentz | 401/202 |
| 7,361,381 | B2 | 4/2008 | Torkelson | |
| 7,377,709 | B2 | 5/2008 | Butler | |
| 7,473,155 | B1 | 1/2009 | Klundt et al. | |

(Continued)

*Primary Examiner* — David Walczak

(74) *Attorney, Agent, or Firm* — Klein, O'Neill & Singh, LLP

(57) ABSTRACT

A hygienic modular writing utensil and method of using for eliminating or minimizing the spread of germs, bacteria and the like between a first and a second user. The utensil has an External Protective Shield with a first holding area for use by the first user and a removable Internal Writing Utensil with a second holding area for use by the second user. The External Protective Shield has an internal cleaning element and the Internal Writing Utensil has a removable cap on its outer end, whereby when the first user pulls the Internal Writing Utensil out from the External Protective Shield or reinserts the Internal Writing Utensil back into the External Protective Shield by grasping the exterior surface of the removable cap, an outer surface of the Internal Writing Utensil, including the second holding area is cleaned.

13 Claims, 4 Drawing Sheets

(56) References Cited

U.S. PATENT DOCUMENTS

| | | | | |
|---|---|---|---|---|
| 7,530,751 | B2 | 5/2009 | Journe | |
| 7,794,167 | B2 | 9/2010 | Lapstun et al. | |
| 7,938,375 | B1 | 5/2011 | Massegee | |
| 8,058,629 | B2 | 11/2011 | Long | |
| D650,441 | S | 12/2011 | Ikeda | |
| D651,246 | S | 12/2011 | Beyer | |
| D651,647 | S | 1/2012 | Chu | |
| 8,096,722 | B2 | 1/2012 | Rolion et al. | |
| 8,100,598 | B2 | 1/2012 | Killion et al. | |
| 8,104,983 | B2 | 1/2012 | Bedhome et al. | |
| 8,152,395 | B2 | 4/2012 | Liu | |
| 8,408,832 | B2 * | 4/2013 | Andochick | 401/48 |

* cited by examiner

HYGIENIC WRITING INSTRUMENT AND METHOD OF USING

CROSS-REFERENCE TO RELATED APPLICATION

This application claims the benefit under 35 USC 119(e) of U.S. Provisional Application Ser. No. 61/741,280 filed on Jul. 17, 2012, the disclosure of the aforementioned provisional application is incorporated herein in its entirety.

FIELD OF THE INVENTION

This invention relates generally to writing instruments or utensils and more specifically to a new innovative modular writing utensil and a method of using the same. The instrument or utensil has two separate and isolated holding or gripping areas on nesting components, portions or units; namely, an External or Outer Protective Layer or Shield and an Inner or Internal Writing Instrument or Utensil. Additionally, the External Protective Shield may include an internal cleaning device to help sanitize the Internal Writing Utensil. Thus, different users may use the present invention and entirely eliminate or minimize inadvertent accidental exposure and cross-contamination of genus, bacteria, or infection between them, in any setting, such as for filling out forms and/or obtaining signatures in the public or private sector.

BACKGROUND OF THE INVENTION

In many situations individuals, such as doctors, other professionals and/or other persons have to get mandatory signatures as part of their normal daily duties. When doing so, they often have to allow others, such as clients, patients, or the like to use their writing utensil, such as a pen. The use of the same writing utensil by more than one person can inadvertently transfer germs and bacteria between such persons, thereby exposing them to each other's germs, bacteria and possible infection.

The usefulness and novelty of the present invention is that the improved writing utensil is capable of permitting a First or Primary User ("PU") and a Second or Secondary User ("SU") to utilize different handling, holding or gripping areas on an External Protective Shield ("EPS") and an Inner Writing Utensil ("IWU"), without having to arbitrarily touch, hold, or contact the same area when filling out required paper work and/or fixing their respective signatures to such paper work, when using the same writing utensil.

The present invention has been specifically designed to eliminate accidental exposure of germs and/or bacteria between the PU and the SU. The invention accomplishes the separation/isolation of germs, etc. through the use of the two separate and differentiated handling, holding or gripping areas on these parated EPS and IWU. These separate units work in conjunction with the method in which they are interchanged during the course of use. The unique way the EPS and the IWU are connected is equally important, since this design enables the PU to eliminate all contact with the area held by the SU during or after their use.

The EPS is designed to be used by the PU (Professional, or the like), while the IWU is designed to be used by the SU (Client, Patient, or the like). The PU can disengage the IWU from the EPS at any time during shared use, allowing the SU to access the IWU to perform the required task. Notably the separate gripping areas of each unit continue to remain separate from each other as the writing utensil is switched back and forth between users. When the SU is finished with the IWU, the PU can simply place the IWU back into the EPS either by holding from a back or rear portion of the IWU, or allowing the SU to place the IWU on a flat surface so that the PU may scoop or pick up the IWU with the EPS and reconnect the two layers without contacting with the gripping area of the IWU, used by the SU.

In a hospital setting the shared use of writing instruments can transfer dangerous germs, bacteria, virus, fungus or other infections leading to what is commonly referred to in the medical community as nosocomial hospital acquired infections. Thus, there exists a need in the art for an improved writing utensil or pen that may be used by shared users without the individual users touching the same area(s) of the writing instrument, thus preventing the passing along of germs or, bacteria and avoiding possible hospital or other acquired infections.

SUMMARY OF THE INVENTION

The present invention provides a modular separable writing utensil that has two distinct components with separate, holding/gripping areas. The internal component or IWU has a removable back end cap that holds or houses a writing devise such as, but not limited to, any type of pen or refill, and or stylus that is gripped by the SU during use. The outer component or EPS is basically an elongated tubular element that has open front and rear ends. Therefore, a tip of the IWU may protrude or stick out of the front end and the IWU may be inserted and withdrawn through the rear end. Additionally, the EPS has a separate gripping/holding area for the PU. When a signature is required from an SU, a PU disengages the EPS from the IWU, for example, by holding the rear of the IWU (which may, have a special cap or gripping area, such as an O-ring or rubberized surface coating) with one hand, and pulling the IWU out of the EPS. The IWU may then be handed to the SU by the special gripping area for their use. The PU keeps control of the EPS during use of the IWU by the SU. After the SU completes and/or signs a document by holding the IWU by the separate holding/gripping area, the SU gives the IWU back to the PU, as described above. The PU then inserts the IWU back into the EPS, thus completing the process.

The EPS preferably includes an internal or built-in cleaning device or portion. This cleaning device houses a cleaning element, such as a gasket capable of holding isopropyl alcohol or other sanitizing agent. As the IWU is removed or inserted back into the EPS the outer surface of the IWU comes into contact with the cleaning element to produce a cleaning effect on the IWU to aid in sanitizing the outer surface of the IWU. Furthermore, when the EPS and IWU are sized and dimensioned so that when attached, an airtight bond or seal is formed between them to prevent oxygen from entering the area between the EPS and IWU, thus inhibiting the growth of bacteria.

In one aspect of the present invention, the design, angle, look, dimensions of the EPS can be changed in a number of ways, which has more to do with design elements, rather than spirit/scope of the invention that allows separate users to keep the two separate gripping/holding areas of the EPS and IWU separated. For example the EPS design may closely follow the IWU design characteristics. This variable is a function contingent on what type of writing instrument is used for the IWU and overall look, as well as what final manufacturing decisions are made.

Broadly, the present invention includes a method of using and a writing device that prevents the transfer of germs, bacteria, etc., when the writing device is used by more than one individual.

Various objects, features, aspects, and advantages of the inventive subject matter will become more apparent from the following detailed description of preferred embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements and the method of using the same. Thus if one embodiment comprises elements A, B, and C, and a second embodiment comprises elements B and D, then the inventive subject matter is also considered to include other remaining combinations of A, B, C, or D and their respective use, even if not explicitly disclosed.

DETAILED DESCRIPTION

Figure 1:
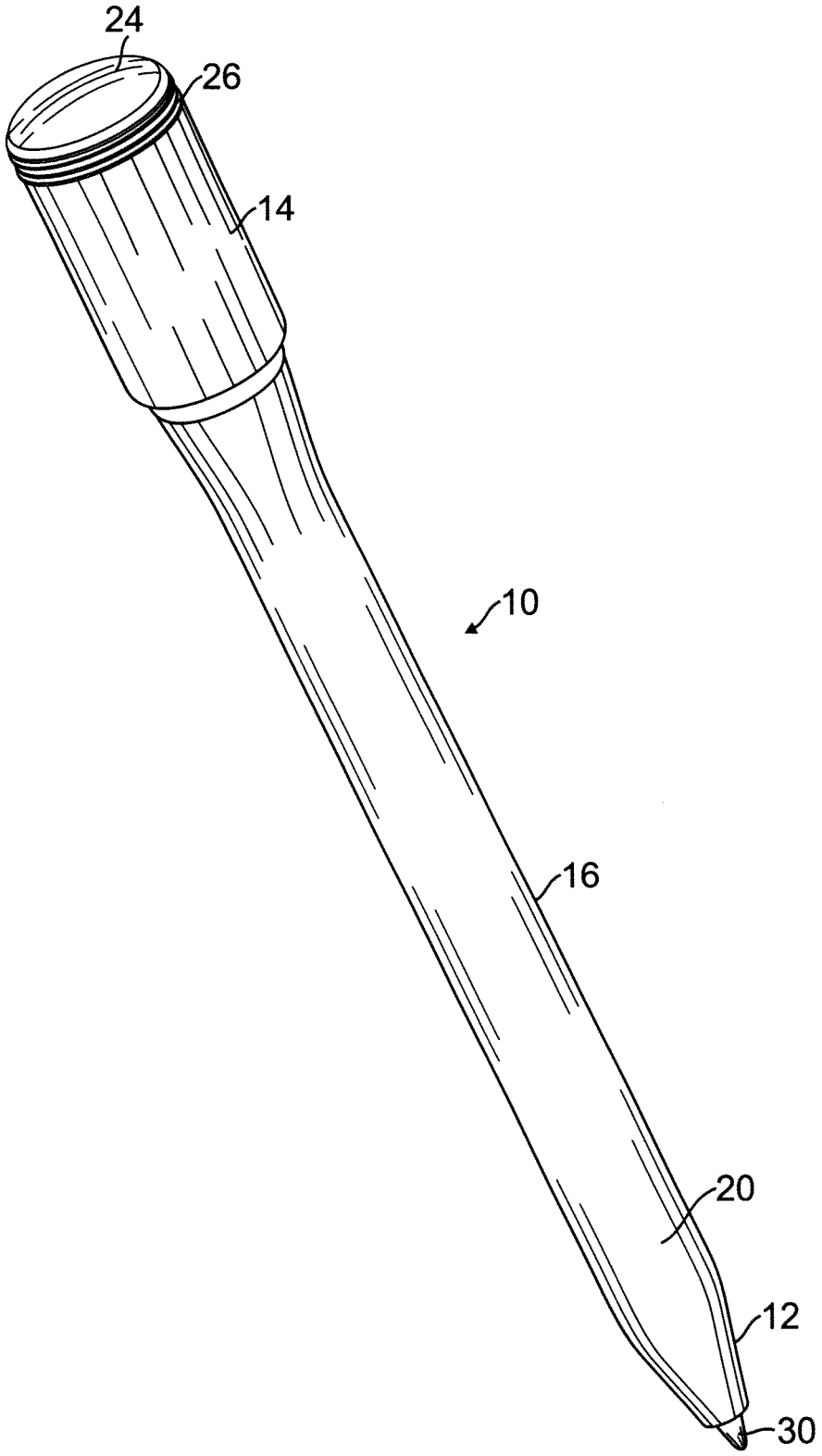
FIG. 1 shows a perspective view of the improved and novel writing instrument of the present invention.

As shown in the drawings, the improved and novel writing instrument of the present invention comprises a writing instrument 10, such as a pen, pencil, or the like, having a first or front end 12 and a second or rear end 14. The writing instrument 10 includes an elongated, hollow external or outer protective shield 16 referred to as an EPS, and an inner writing utensil or IWU 18. Both the EPS 16 and the IWU 18 have separate, gripping/holding areas indicated by 20, 22. These holding areas 20, 22 are held by the different users during use of the writing instrument 10, for example, during the signing of a document, filling out of a form, making a drawing or a sketch, etc.

Furthermore, the rear end 14 is preferably formed as a cap releasably held on an outer end of the IWU 18. The cap 14 includes an outer end 24 that holds or secures the IWU 18 in place. The cap 14 may include one or more O-rings 26, or other type of resilient material on the exterior thereof, for aid in gripping and removing the IWU from the EPS and/or for use in turning a page of a multi-page document.

The front end 12 of the hollow, elongated EPS 16 has an opening 28 so that a tip 30 of the IWU 18 protrudes or sticks out of the front end when the EPS and IWU are secured together. A Primary User (PU) may therefore, write with the instrument 10 when gripping it by the area 20.

Figure 2:
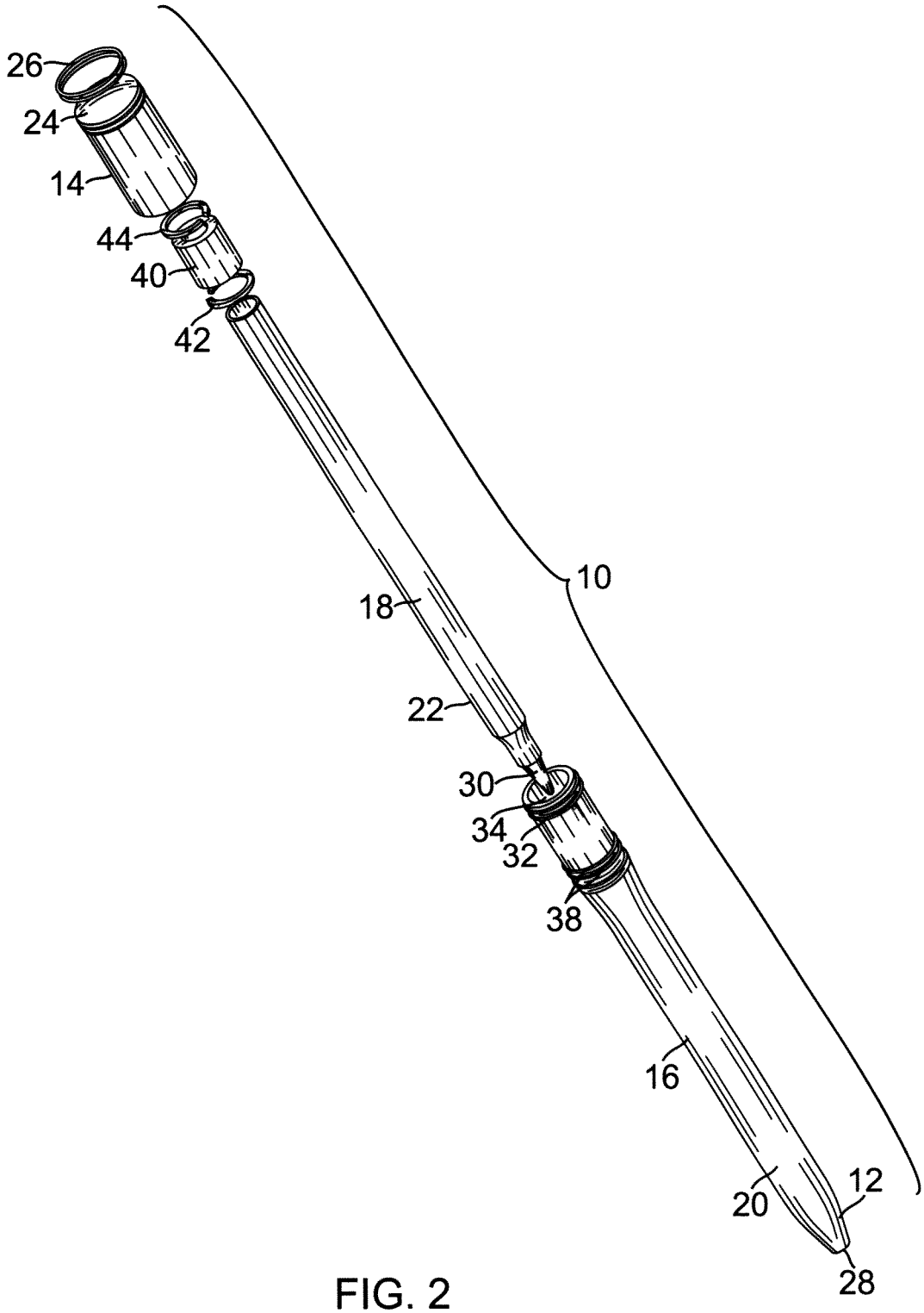
FIG. 2 is an exploded perspective view of the writing instrument of FIG. 1.
Figure 3:
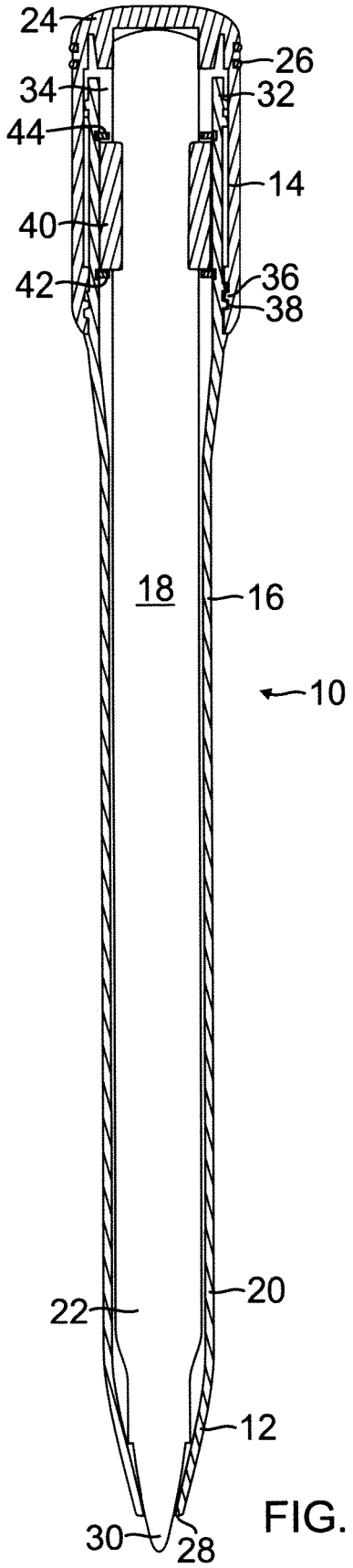
FIG. 3 is a cross sectional view of the writing instrument of FIG. 1.
Figure 4:
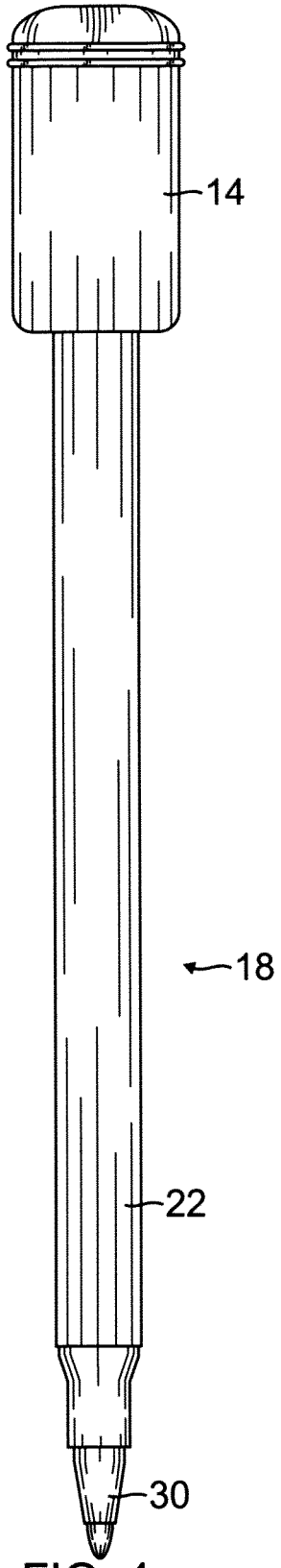
FIG. 4 is a front elevational view of the internal writing utensil having an outer end cap secured thereto, removed from the external shield portion.

As best shown in FIGS. 2 and 3, an outer end 32 of the EPS 16 has an opening 34 through which the IWU 18 is inserted and withdrawn by the PU. When a signature is required from a Secondary User (SU), the PU disengages the EPS 16 from the IWU 18, as by holding the rear end cap 14 of the IWU, for example, over the O-rings 26 with the fingers of one hand, and pulling the IWU out of the EPS. The IWU may then be handed to the SU by the cap 14 for use. by the SU. After the SU completes and/or signs a document when holding the IWU 18 by the separate holding/gripping area 22, the SU gives the IWU back to the PU or places it on a flat surface so that the PU may insert the IWU back into the EPS until internal grooves or teeth 36 on the interior of the rear end 14 mesh with exterior grooves or teeth 38 on the EPS 16, thus re-securing the writing instrument 10 together. It is to be understood that the cap 14 when secured to the outer end of the EPS, is removably held on the outer end 32 of the EPS 16 by any known means, including, but not limited to threading on, force fit, friction, magnetic attraction, etc.

As also shown in FIGS. 2 and 3, the EPS 16 includes an internal or built-in cleaning device or system having a cleaning element 40, such as felt or gasket held in place by snap rings 42, 44, or other types of securing means. The cleaning element 40 is impregnated with or holds isopropyl alcohol or another sanitizing agent, so that when the IWU 18 is removed or inserted back into the EPS 16 the outer surface of the IWU comes into contact with the cleaning element to aid in cleaning the outer surface of the IWU, and in particular the gripping/holding area 22. Furthermore, the IWU 18 and the EPS 16 are sized and dimensioned so that when attached, an airtight bond or seal is formed between them to prevent oxygen from entering the area between them. These substantially airtight seals are formed at the outer surface on the inner and outer ends of the IWU 18 where they meet the interior surface of the EPS 16, to limit or prevent oxygen from entering between the EPS and IWU, thus inhibiting the growth of bacteria.

It can be seen that steps of removing and reinserting of the separate components 16, 18 of the writing instrument 10 of the present invention allows a Primary User and a Secondary User to separately grasp different gripping/holding areas to limit or entirely eliminate the passing of germs, bacteria, etc. between the users.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A modular hygienic writing instrument having a pair of separate components: a first of the pair of components consisting of an elongated, hollow exterior protective shield having a first open end and a second open end; a second of the pair of components consisting of an interior writing utensil having a writing tip end and a capped outer end held in the elongated, hollow exterior protective shield with the writing tip end extending out of the first open end and the outer capped end secured over the second open end; the exterior protective shield having a first holding area thereon adjacent the first open end and the interior writing utensil having a second separate holding area thereon, adjacent the tip end; a cleaning system secured in the interior of the elongated, hollow exterior protective shield adjacent the second open end and in contact with an exterior surface of the interior writing instrument; and wherein the cleaning system includes a cleaning element having a sanitizing agent held therein secured in the interior of the elongated, hollow exterior protective shield by a pair of securing elements.

2. The modular hygienic pen of claim 1 wherein the pair of securing elements are snap rings.

3. The modular hygienic pen of claim 1 wherein the sanitizing agent is isopropyl alcohol.

4. The modular hygienic pen of claim 1 wherein the pair of separate components are sized and dimensioned so that when attached together an airtight seal is formed between them to prevent oxygen from entering the area there between, thus inhibiting the growth of bacteria.

5. A modular hygienic writing instrument having a pair of separate components: a first of the pair of components consisting of an elongated, hollow exterior protective shield having a first open end and a second open end; a second of the pair of components consisting of an interior writing utensil having a writing tip end and a capped outer end held in the elongated, hollow exterior protective shield with the writing tip end extending out of the first open end and the outer capped end secured over the second open end; the exterior protective shield having a first holding area thereon adjacent the first open end and the interior writing utensil having a second separate holding area thereon, adjacent the tip end; and a cleaning system secured in the interior of the elongated, hollow exterior protective shield adjacent the second open end and in contact with an exterior surface of the interior writing instrument.

6. The modular hygienic pen of claim 5 wherein the cleaning system includes a cleaning element having a sanitizing agent held therein secured in the interior of the elongated, hollow exterior protective shield by a pair of securing elements.

7. The modular hygienic pen of claim 5 wherein the pair of securing elements are snap rings and the sanitizing agent is isopropyl alcohol.

8. The modular hygienic pen of claim 7 wherein the pair of separate components are sized and dimensioned so that when attached together an airtight seal is formed between them to prevent oxygen from entering the area there between, thus inhibiting the growth of bacteria.

9. A method of using a writing utensil to eliminate the passing of germs, bacteria and the like between a first user and a second user, comprising the steps of: providing a modular writing utensil with separate components having separate holding areas; the first of the separate components comprising a writing utensil with a first holding area thereon; attaching a cap to an outer end of the writing utensil; inserting the writing utensil into a second component comprising an elongated hollow exterior protective sleeve having an open lower end, an open upper end and a second holding area on an exterior surface; inserting the writing instrument into the elongated hollow exterior protective sleeve until a tip end extends out of the open lower end and securing the cap to the upper open end; having the first user grip the exterior protective sleeve by the second holding area to write with the modular writing instrument; after using, the first user grasps the cap and pulls the cap and attached writing utensil out of the elongated hollow exterior protective sleeve and hands the writing utensil to the second user whereby the second user grips the writing utensil by the first holding area to write with and then hand back to the first user for reinsertion into the elongated hollow exterior protective sleeve until the cap is secured to the open upper end and the tip end extends from the lower open end.

10. The method of claim 9, further including the step of providing a cleaning element inside of the elongated hollow exterior protective sleeve and cleaning the exterior of the writing utensil as it is inserted into or pulled from the elongated hollow exterior protective sleeve.

11. The method of claim 9, further including providing the cleaning element with a sanitizing agent.

12. The method of claim 9 wherein the sanitizing agent provided is isopropyl alcohol.

13. The method of claim 9, further including the step of sizing and dimensioning the separate components so that when they are attached together an airtight seal is formed between them to prevent oxygen from entering, thus inhibiting the growth of bacteria in the interior of the writing utensil.

* * * * *